United States Patent [19]

Myslicki

[11] Patent Number: 5,046,768

[45] Date of Patent: Sep. 10, 1991

[54] PRIMARY AND SECONDARY HOOD LATCH WITH POP-UP AND PRESENTER LEVER

[75] Inventor: Robert J. Myslicki, W. Bloomfield, Mich.

[73] Assignee: General Motors Corporation, Detroit, Mich.

[21] Appl. No.: 552,641

[22] Filed: Jul. 16, 1990

[51] Int. Cl.[5] ..... E05C 5/04

[52] U.S. Cl. ..... 292/68; 292/DIG. 14; 292/DIG. 5; 292/59; 292/304

[58] Field of Search ..... 292/68, DIG. 5, 254, 292/DIG. 25, 59, 213, 218, DIG. 14, 304; 180/69.21

[56] References Cited

U.S. PATENT DOCUMENTS

| | | | |
|---|---|---|---|
| 2,809,064 | 10/1957 | Dlugatch | 292/DIG. 14 |
| 2,828,989 | 4/1958 | Kaiser | 292/304 |
| 2,834,626 | 5/1958 | Claude-Mantle | 292/DIG. 14 |
| 3,966,244 | 6/1976 | Kleisser et al. | 292/127 |
| 4,702,505 | 10/1987 | Alexander | 292/DIG. 5 |
| 4,756,562 | 7/1988 | Foster et al. | 292/28 |
| 4,961,601 | 9/1990 | Lindholm et al. | 292/DIG 14 |

FOREIGN PATENT DOCUMENTS

| | | | |
|---|---|---|---|
| 462482 | 3/1937 | United Kingdom | 292/59 |

*Primary Examiner*—Gary L. Smith

*Assistant Examiner*—Darnell M. Boucher

*Attorney, Agent, or Firm*—Raymond I. Bruttomesso, Jr.

[57] ABSTRACT

A latch mechanism for a vehicle closure panel hingedly mounts to a vehicle body panel and latches the closure panel in a closed position. A striker post is rotatably connected to one panel. A handle is mounted to the striker post and allows the striker post to be manually rotated, when the handle extends outwardly in an extended position. A striker guide is mounted on the other panel and has an open ended slot therein engaged by the striker post upon closing movement of the closure panel. The slot is angularly disposed to rotate the striker post from the extended position upon movement of the closure panel toward the closed position. A primary latch engages the striker post to hold the closure panel in the closed position and is releasable to allow movement of the closure panel from the closed position toward an opened position. A pop-up spring moves the closure panel from the closed position toward the open position so that the slot rotates the striker post toward the extended position. A retaining abutment projects into the slot for limiting the movement of the striker post upward in the slot, thereby limiting the closure panel movement toward the open position until manual movement of the handle disengages the striker post from the retaining abutment which allows further opening movement of the vehicle closure panel.

5 Claims, 2 Drawing Sheets

PRIMARY AND SECONDARY HOOD LATCH WITH POP-UP AND PRESENTER LEVER

This invention relates to a hood latch and more particularly to a hood latch having a secondary latch release handle that is presented upon the releasing of a primary hood latch.

BACKGROUND OF THE INVENTION

It is known to have a hood latch assembly including a primary latch which may be released from the interior of the vehicle as desired and a secondary or safety latch which holds the hood in a partially open position after the primary latch is released.

It is also known to provide a handle under the hood for operating the secondary latch to allow full opening of the hood. The hood is biased upwardly when the primary latch is released, thereby leaving a small gap or opening into which a person may extend their hand to grasp the handle and operate the secondary latch. The location of this handle for the secondary latch is not the same from model to model due to differences in design and may be difficult to reach.

It is known to provide a release lever on the secondary latch such as disclosed in U.S. Pat. No. 3,966,244, where the release lever is presented upon unlatching of the primary latch The release lever is pivotally mounted to and moves with the secondary latch.

It would be desirable to provide a secondary latch release handle which is integral with the striker and is presented whenever the primary latch is unlatched.

SUMMARY OF THE INVENTION

This invention provides a latch mechanism for a vehicle closure panel hingedly mounted to a vehicle body panel. The closure panel moves between an opened position and a closed position. The latch mechanism latches the closure panel in the closed position and has a striker post rotatably connected to one panel and projecting laterally therefrom. A handle is mounted to the striker post and allows the striker post to be manually rotated, when the handle extends outwardly in an extended position. A striker guide is mounted on the other panel and has an open ended slot therein engaged by the striker post upon closing movement of the closure panel. The slot is angularly disposed to rotate the striker post from the extended position upon movement of the closure panel toward the closed position A primary latch engages the striker post to hold the closure panel in the closed position and is releasable to allow movement of the closure panel from the closed position toward the opened position. A pop-up spring moves the closure panel from the closed position toward the opened position by rotating the striker post upward in the slot and toward the extended position A retaining abutment projects into the slot for limiting the movement of the striker post upward in the slot, thereby limiting the closure panel movement toward the opened position until manual movement of the handle disengages the striker post from the retaining abutment which allows further opening movement of the vehicle closure panel.

One object, feature and advantage resides in the provision of a handle carried by a rotatable striker and rotated by a striker guide from a retracted position to a extended position as hood panel moves from the closed position towards the open position.

Another object, feature and advantage of the invention resides in the provision of a striker guide having an open ended slot for guiding a rotatably mounted striker post and the striker guide having a retaining abutment projecting into the slot for limiting the movement of the striker post upward in the slot until manual movement of the handle disengages the striker post from the retaining abutment to allow further opening movement of the vehicle closure pane.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
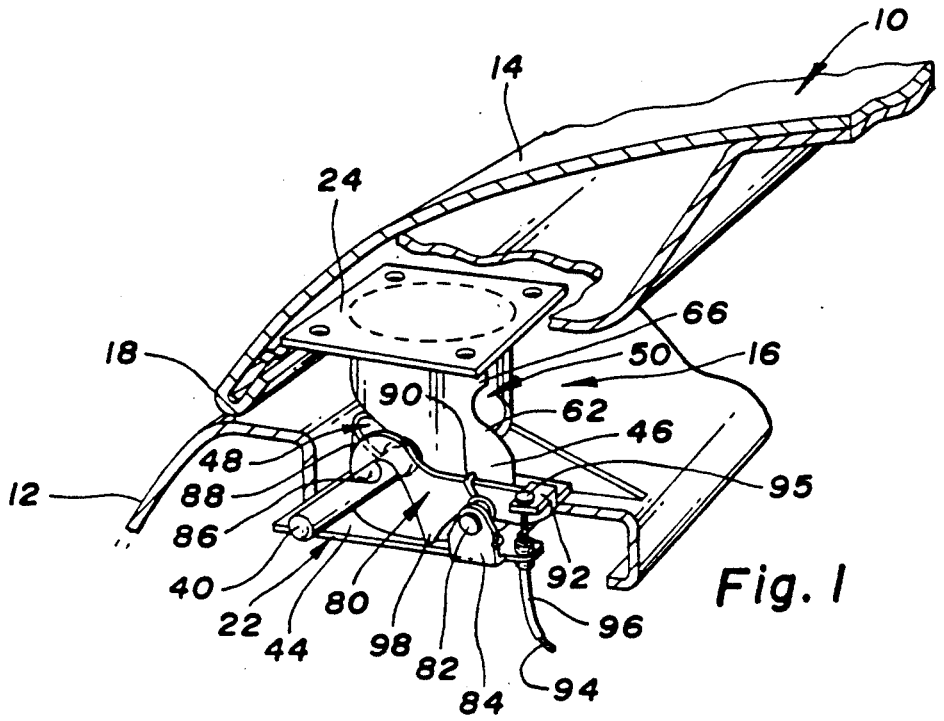
FIG. 1 is a fragmentary perspective view of the forward portion of the vehicle with the hood in the closed position.

A motor vehicle 10 has a vehicle panel 12 to which a closure panel or hood 14 is pivotally attached for movement between an opened position and a closed position. A latch mechanism 16 disengageably connects a non-hinged end 18 of the closure panel 14 to the vehicle panel 12 as seen in FIG. 1.

Figure 3:
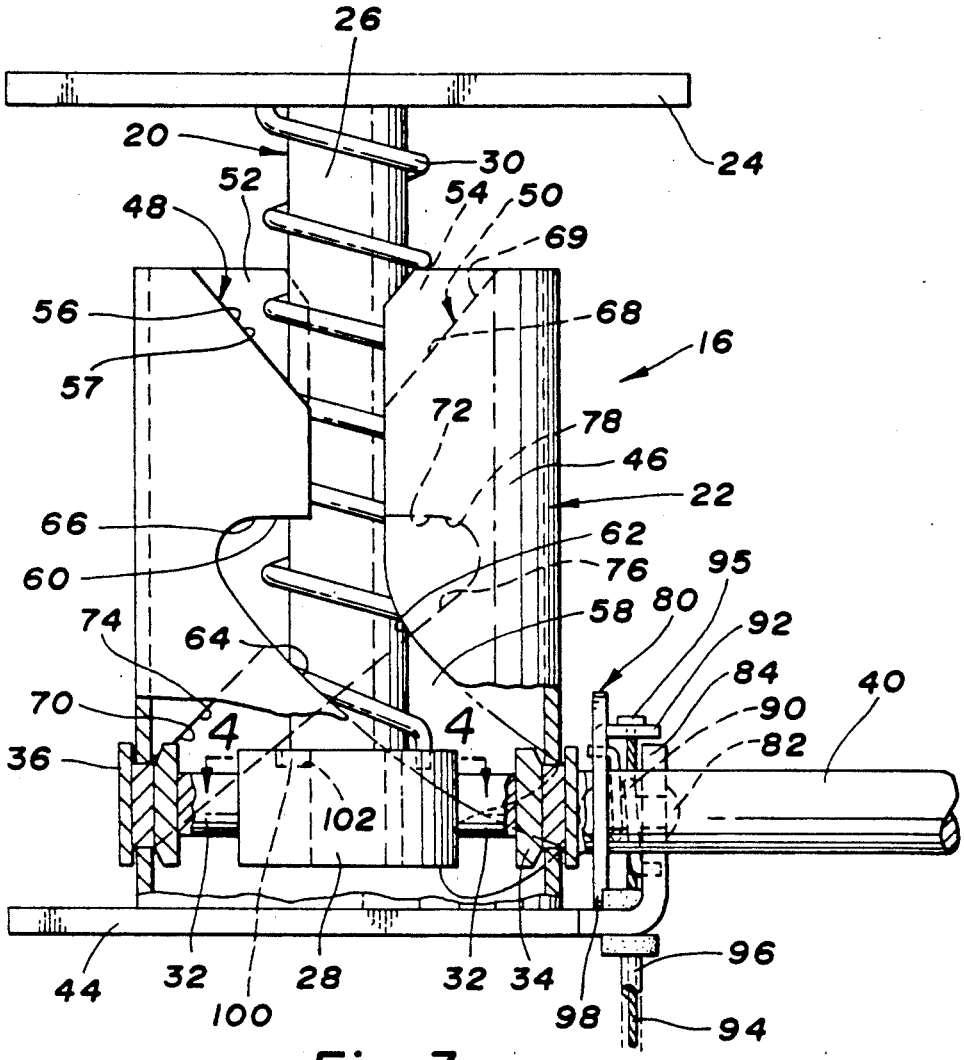
FIG. 3 is an elevation view of the latch mechanism in the primary latched position.
Figure 4:
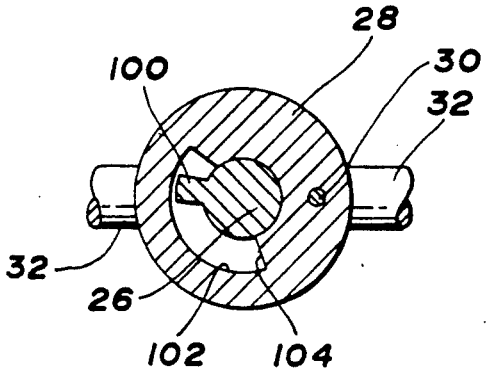
FIG. 4 is a sectional view taken in the direction of arrows 4—4 of FIG. 3 and showing the bushing and the post member.

The latch mechanism 16 has a striker portion 20 and a latch portion 22 as best seen in FIG. 3. The striker portion 20 has a mounting plate 24 attached to the closure panel 14 as seen in FIG. 1. FIG. 3 shows a post member 26 which is securely affixed perpendicular to the mounting plate 24. A bushing 28 is pivotally attached to the other end of the post member 26. FIG. 4 shows a stop bar 100 that projects perpendicular from the post member 26 and is received by a groove 102 in the bushing 28. The stop bar 100 is engageable with an edge 104 of the groove 102 to limit rotation of a striker post 32 in the clockwise direction. FIG. 3 shows the striker post 32 which extends through and is welded or otherwise suitably attached to the bushing 28. The striker post 32 rotates with the bushing 28 in relation to the post member 26. A torsion spring 30 encircles the post member 26 and has one end secured to the mounting plate 24 and the other end secured to the bushing 28 for biasing the striker post 32 in the clockwise direction.

The striker post 32 has a pair of rotatably mounted rollers 34 and 36, one mounted on each end of the striker post 32 as seen in FIG. 3. The rollers 34 and 36 interact with the latch portion 22 as will be discussed below. A handle 40 is mounted to the striker post 32 and forms a continuation of the striker post 32. The handle 40 and the striker post 32 rotate from a retracted position shown in FIG. 1 to an extended position as shown in FIG. 2, where the handle 40 extends outwardly of the closure panel 14.

FIG. 1 shows the latch portion 22 which has a mounting plate 44 attached to the vehicle panel 12. A cylindrical striker guide 46 is mounted on the mounting plate 44 as best seen in FIG. 3. A pair of slots 48 and 50 are cut on opposite sides of the cylindrical striker guide 46. The slots 48 and 50 form a pair of openings 52 and 54 that are on the opposite edge of the cylindrical striker guide 46 from the mounting plate 44. As seen in FIG. 3, the slot 48 has a bight portion 56 at the opening 52 and a helical slot portion 58 that extends below the bight portion 56 toward the end of the cylindrical striker guide 46 near the mounting plate 44. The bight portion 56 has a ramp edge 57 for rotating the striker post 32 as the closure panel 14 is moved from the opened position. The helical slot portion 58 has a top sloping edge 62 and a top end 66 connected to a bottom sloping edge 64. The top edge 60 is located below the ramp edge 57 of the bight portion 56. A retaining abutment 66 is defined by the top end 60 of the helical slot portion 58 and retains the striker post 32 in a secondary latched position. The other slot 50 shown in dashed lines in FIG. 3 is similarly constructed with a bight portion 68 having a ramp edge 69, a helical slot portion 70 with a top end 72, a top sloping edge 74 and a bottom sloping edge 76. A retaining abutment 78 is defined by the top end 72.

Figure 2:
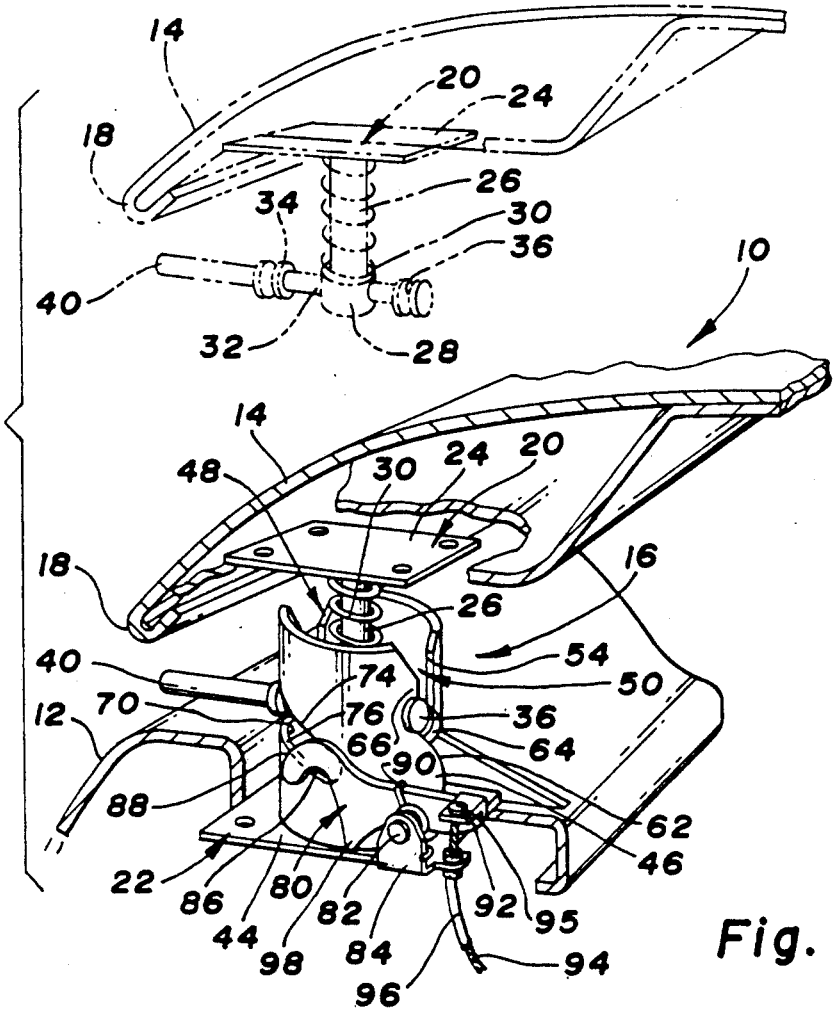
FIG. 2 is a perspective view of the forward portion of the vehicle with the hood in the secondary latched position and the striker retained by the retaining abutment and the handle in the extended position. The hood in the open position is shown in phantom.

FIG. 2 shows a hook lever 80 which is pivotally attached by a rivet 82 to a tab 84 that projects from the mounting plate 44. A hook portion 86 is formed on the lower edge of the hook lever 80 for engaging the handle 40 when the closure panel 14 is in the closed position shown in FIGS. 1 and 3. As best seen in FIG. 2, a curved surface 88 on the forward portion of the hook lever 80 near the hook portion 86 is shaped so that as the closure panel 14 is closed, the handle 40 makes contact with the curved surface 88 and forces the hook lever 80 to rotate up as discussed below. FIG. 3 shows a hook spring 90 which acts between the tab 84 and the hook lever 80 to bias the hook lever 80 toward the mounting plate 44 so that hook portion 86 engages the handle 40 to retain the striker 20. Referring to FIG. 1, a stop tab 98 projects from the hook lever 80 towards the mounting plate 44 to prevent the hook lever 80 from rotating to far counterclockwise A cable 94 connects a primary hood release handle inside the car, not shown, to a tab 92 formed on the hook lever 80. The cable 94 runs through a sheath 96 which is mounted at one end to the mounting plate 44. The cable 94 runs freely through a hole in tab 92 and has a fitting 95 cinched on the end so that the cable 94 may rotate the hook lever 80 clockwise by the fitting 95 engaging the tab 92. However, the hook lever 80 may rotate clockwise with the cable 94 running freely through the hole in the tab 92. Therefore, the handle 40 makes contact with the curved surface 14 rotating the hook lever 80 clockwise, the hook lever 80 and tab 92 are able to rotate clockwise without the cable 94 moving.

To open the closure panel 14, the primary hood release handle inside the car is pulled. The cable 94 rotates the hook lever 80 in the opposite direction from the bias caused by the hook spring 90. The hook portion 86 of the hook lever 80 is lifted from engagement with the handle 40 and the torsion spring 30 rotates the striker post 32 and the handle 40 in relation to the mounting plate 44. The hook lever 80 returns to the position shown in FIG. 2 after the cable 94 is released. The torsion spring 30 acts as a pop-up spring and urges clockwise rotation of the striker post 32 so that the rollers 34 and 36 ride against the bottom sloping edges 64 and 76 of the helical slots 58 and 70 moving the striker portion 20 and the closure panel 14 up several inches in the opening direction. The striker post 32 stops rotating when the rollers 34 and 36 reach the retaining abutments 66 and 78 at the top ends 60 and 72 of the helical slots 58 and 70, thereby establishing the closure panel 14 in the secondary latch position as shown in FIG. 2. When the striker post 32 and rollers 34 and 36 are in this position, the handle 40 is in the extended position projecting out from underneath the closure panel 14 as shown in FIG. 2.

To unlatch the hood or closure panel 14 from this secondary latch position, the operator must rotate the handle 40 counterclockwise slightly so that the rollers 34 and 36 are disengaged from the retaining abutments 66 and 78. The operator then uses the closure panel 14 and the handle 40 to raise the striker post 32 upward through the bight portions 56 and 68 of the slots 48 and 50 of the cylindrical striker guide 46 enabling the closure panel 14 to be fully opened. When the handle 40 is released, the torsion spring 30 rotates the striker post 32 and the handle 40 to a position aligned with the ramp edges 57 and 69 of the bight portions 56 and 68 slightly clockwise of the retaining abutments 66 and 78 as shown in phantom in FIG. 2. Referring to FIG. 4, the striker post 32 is prevented from rotating further clockwise by the edge 104 of the groove 102 in the bushing 28 engaging the stop bar 100 of the post member 26.

When the closure panel 14 is lowered, the striker post 32 with its rollers 34 and 36 pass into the bight portions 58 and 68 of the slots 48 and 50 and roll down the ramp edges 57 and 69. As the closure panel 14 continues to be lowered, the torsion spring 30 rotates the striker post clockwise against the retaining abutments 66 and 78 into the secondary latched position shown in FIG. 2. With further downward movement of the closure panel 14, the striker post 32 rotates counterclockwise as the rollers 34 and 36 follow the helical slots 58 and 70 increasing the clockwise bias of the torsion spring 30.

When the closure panel 14 is forced lower, the handle 40 comes in contact with the curved surface 88 of the hook lever 80. The handle 40 pushes against the curved surface 88 forcing the curved surface 88 upward, pivoting the hook lever 80 in an upward direction This continues until the handle 40 is below the curved surface 88 so that the hook spring 90 forces the hook lever 80 back into its original position shown in FIG. 1, with the handle 40 of the striker post 32 engaged by the hook portion 86 of the hook lever 80. The torsion spring 30 will maintain the striker post 32 securely against the hook lever 80, latching the closure panel 14 in the closed position as shown in FIG. 1.

While an embodiment of the present invention has been explained, various modifications within the spirit and scope of the following claims will be readily apparent to those skilled in the art.

The embodiments of the invention in which an exclusive property or privilege is claimed are defined as follows:

1. A latch mechanism for a vehicle closure panel hingedly mounted on a vehicle body panel and movable between an opened position and a closed position, the latch mechanism latching the closure panel in the closed position comprising:

a striker post rotatably carried by one of the panels and projecting laterally therefrom;

a handle connected to the striker post by which the striker post may be manually rotated when rotation of the striker post to an extended position extends the handle outwardly of the vehicle body panel;

a striker guide mounted on the other of the panels and having an open ended slot therein engaged by the striker post upon closing movement of the closure panel, the slot being angularly disposed to rotate the striker post from the extended position upon movement of the closure panel toward the closed position;

a primary latch means for retaining the vehicle closure panel in the closed position and being releasable to allow movement of the vehicle closure panel from the closed position toward the opened position;

a pop-up spring means for moving the vehicle closure panel from the closed position toward the opened position so that the slot rotates the striker post toward the extended position; and a retaining abutment projecting into the slot for limiting movement of the closure panel toward the opened position until manual movement of the handle disengages the striker post from the retaining abutment to allow further opening movement of the vehicle closure panel.

2. A latch mechanism for a vehicle closure panel hingedly mounted to a vehicle body panel, the closure panel having movement between an opened position and a closed position, the latch mechanism latching the closure panel in the closed position comprising:

a post member mounted on one of the panels and extending toward the other of the panels;

a striker post mounted on the post member and projecting laterally therefrom and rotatable in relation to the panel;

a handle connected to the striker post by which the striker post may be manually rotated when rotation of the striker post to an extended position extends the handle outwardly of the vehicle body panel;

a cylindrical striker guide mounted on the other of the panels and receiving the post member therein upon movement of the closure panel to the closed position relative the vehicle panel, the striker having an open ended helical extending slot engaged by the striker post upon closing movement of the closure panel to rotate the striker post form the extended position upon movement of the vehicle closure panel toward the closed position;

a primary latch means for retaining the vehicle closure panel in the closed position and being releasable to allow movement of the vehicle closure panel from the closed position to the opened position;

a rotation means for biasing the striker post toward the extended position to thereby rotate the striker post toward the extended position following the helical extending slot to move the vehicle closure panel from the closed position toward the opened position; and a retaining abutment projecting into the slot for limiting movement of the closure panel toward the opened position until manual movement of the handle disengages the striker post from the retaining abutment to allow further opening movement of the vehicle closure panel.

3. A latch mechanism for latching a hingedly mounted vehicle closure panel to a vehicle panel; comprising:

a post member mounted on one of the panels and extending toward the other of the panels;

a striker post rotatably mounted to the post member and projecting laterally therefrom;

a handle mounted to the striker post by which the striker post may be manually rotated when rotation of the striker post to an extended position extends the handle outwardly of the vehicle body panel;

a spring for biasing the rotation of the striker post moving the handle to the extended position;

a cylindrical striker guide mounted on the other of the panels and receiving the post member therein upon movement of the closure panel to a closed position relative the vehicle panel, and the striker guide having a first open ended helical extending slot for engagement by the striker post upon movement of the closure panel toward the closed position;

a hook lever for latchingly engaging the striker post within the helical slot retaining the closure panel in the closed position relative to the vehicle panel, and the hook lever being releasable from the striker to allow movement of the vehicle closure panel from the closed position to the open position;

and a retaining abutment projecting into the slot for limiting movement of the closure panel toward the opened position until manual movement of the handle disengages the striker post from the retaining abutment to allow further opening movement of the vehicle closure panel.

4. A latch mechanism as in claim 3, wherein the cylindrical striker guide has a second open ended helical extending slot for receiving the striker post.

5. A latch mechanism as in claim 4, wherein a pair of rollers are mounted on the striker post for engagement with the open ended helical extending slots in the cylindrical striker.

* * * * *